US006027230A

United States Patent [19]

Huber et al.

[11] Patent Number: 6,027,230

[45] Date of Patent: Feb. 22, 2000

[54] SOCKET ADAPTER

[75] Inventors: Mortimer Huber, White Bear Lake; Salvador Mendez, Roseville, both of Minn.

[73] Assignee: Quality Manufacturing Incorporated, St. Paul, Minn.

[21] Appl. No.: 09/052,627

[22] Filed: Mar. 31, 1998

[51] Int. Cl.[7] ..... F21K 2/00

[52] U.S. Cl. ..... 362/260; 362/226; 439/242

[58] Field of Search ..... 439/242, 243; 362/226, 260, 812; 40/564

[56] References Cited

U.S. PATENT DOCUMENTS

| | | | |
|---|---|---|---|
| 3,060,310 | 10/1962 | Bertsche, Jr. et al. | 439/242 |
| 5,475,576 | 12/1995 | Daniels | 362/260 X |

OTHER PUBLICATIONS

Americans With Disabilities Act of 1990 (20 pages total, pp. 31–50).

36 C.F.R. Ch. XI, Pt. 1191, App. A, 4.4 Protruding Objects (Jul. 1, 1996 Edition) (2 pages total, pp. 688–689).

World Wide Web (WWW) Pages (2 pages Total) first Page: "Welcome To: American Lighting...", © Apr. 1997.

World Wide Web (WWW) Pages (4 pages Total) Lamp Holders By KULKA, © Apr. 1997.

World Wide Web (WWW) Pages ( 1 page Total) Kulka 1550 Series, © 1996.

World Wide Web (WWW) Pages (4 pages Total) Kulka 582/583 Series, © 1996.

*Primary Examiner*—Stephen Husar

*Attorney, Agent, or Firm*—Michael S. Sherrill

[57] ABSTRACT

There is disclosed a socket adapter for a receiving a socket, the socket designed to receive fluorescent tubes. The socket adapter is of a configuration that can receive a portion of the socket in a manner such that the distance between center of the socket, as taken from a second socket portion where the fluorescent tube attaches to the edge of housing, where the socket is mounted to a surface, is minimized. This socket adapter structure contributes to reducing the distance between the rear wall of the cabinet and the center of the socket (or center of the bulb, e.g., fluorescent tube, when the bulb is electrically connected in the socket), when compared to the prior art "tombstone" sockets, assisting in and allowing for the creation of "low profile " signs.

17 Claims, 7 Drawing Sheets

SOCKET ADAPTER

FIELD OF THE INVENTION

The present invention is directed to signs and related signage, and in particular to a device used in the cabinets or light boxes of the signs that receives sockets, that attach and electrically connect to fluorescent tubes (also known as fluorescent bulbs or fluorescent lamps). The device is of a construction that decreases the distance between the socket center/fluorescent tube (light) center and the rear wall of the cabinet, when compared to conventional sockets. This decreased distance between the socket center/fluorescent tube center and the rear walls of the cabinets allows for the production of "low profile " signs, as cabinet or light box depth can be reduced, when compared to conventional cabinets or light boxes.

BACKGROUND OF THE INVENTION

Signage is common for basic communications and is the most popular form of advertising worldwide. Advertising signage, for example, is extremely effective in the form of illuminated point of purchase signs, commonly found in airport terminals, bus and train stations, sporting arenas or stadiums, convention centers, hotels, and other public walkways, or places of high pedestrian traffic. These signs are decorative multicolored arrays and are retained in outwardly protruding illuminated cabinets or light boxes, the cabinets mounted on a wall, or other stable support structure, for example, a balcony front at a sporting arena or stadium.

Two exemplary signs 20, 20' of overall length (L, L') and overall depth (D, D') are mounted on walls 21, as illustrated in FIGS. 1, 2*a*, 2*b*, 3 and 4*a*–4*b*. These drawing figures are diagrammatic, to illustrate the structures detailed below, and accordingly are not to scale. Both of these signs 20, 20' include cabinets 22 (also known as a light box), of sheet metal or the like, with bodies 24, having rear 25, side 26*a*, 26*b*, upper 27 and lower 28 walls, an open front (side).

The bodies 24 of both signs 20, 20' may also include borders 29 (continuous or non-continuous along the periphery of the open side of the cabinet body 24), affixed to the cabinet walls 26*a*, 26*b*, 27, 28 by conventional mechanisms, to assist in preventing the graphic unit 32 from moving (or being pushed into) the cabinet 22. The borders 29 preferably have their outermost surfaces flush with the edges of the side 26*a*, 26*b*, upper 27 and lower 28 walls at the open side of the cabinet body 24, and may include an indented section (not shown), typically referred to as a screw trough, for receiving screws 35, rivets or the like.

The cabinets 22 enclose lights, for example, 800 milliamp (ma) fluorescent tubes 30 (also referred to as fluorescent lamps), of lengths ranging from eighteen inches to ten feet (46 cm to 304 cm), and diameters typically approximately 1.5 inches (3.81 cm), or other suitable illuminating devices. In both signs 20, 20', the fluorescent tube arrangement(s) are exemplary, and additional similar arrangements within these cabinets 22 are permissible if desired.

A graphic unit 32 is positioned in a retainer 34 (frame). This retainer 34 holds the graphic unit 32 in place against the cabinet body 24, as the graphic unit 32 abuts the edges of the side 26*a*, 26*b*, upper 27 and lower 28 walls and the borders 29. The retainer 34 is made of individual members 34*a*, preferably four (one for each cabinet periphery side), each member having lips 34*b* that abut the edges of the side 26*a*, 26*b*, upper 27 and lower 28 walls when the signs 20, 20' are properly formed. Each of the members 34*a* that form the retainer 34 attach to the cabinet body 24 by clamping screws 35, conventional threaded screws received in openings in the cabinet body 24, latches, hinges, or other similar attachments. When any retainer member 34*a* is removed from the cabinet body 24, the graphic unit 32 can be removed by being slid therefrom. Other conventional retainers for the graphic unit 32, such as friction fitting members, are also permissible.

The graphic unit 32, typically includes a graphic 36 (typically a transparency), sandwiched between a diffuser panel 38 (typically a translucent polymeric or plastic sheet), oriented rearward toward the cabinet rear wall 25, and a protective cover member 40 (typically a transparent or clear polymeric material), held in contact by the sandwich arrangement. The cabinet 22 of each sign 20, 20' has an internal length (l), from the innermost surface of the sidewall 26*a* to the innermost surface of the opposite sidewall 26*b*, and an internal depth (d), from the rear wall 25 to diffuser panel 38 (alternately expressed as the distance from the rear wall 25 to the plane formed by the edges of the side 26*a*, 26*b*, upper 27 and lower 28 walls along the open side of the cabinet body 24).

As shown by the sign 20, where the internal cabinet lenght (l) is ten feet (304 cm) or less, a single fluorescent tube 30, or tubes, depending on the sign height, span or spans, the entire internal cabinet lenght (l). Each fluorescent tube 30 is received in electrical connection and in a coaxial alignment with the respective sockets 42*a*, 42*b* (the center point of the socket substantially aligned with the center point of the fluorescent tube). For example, these sockets 42*a*, 42*b*, may be KULKA brand lamp sockets Cat. No. 582, 660 W-600 V/1000 V, available from Voltarc Technologies, Inc., 400 Captain Neville Drive, Waterbury, Conn. 06705, USA. The sockets 42*a*, 42*b* are mounted on oppositely disposed sidewalls 26*a*, 26*b* of the cabinet 22. These sidewalls 26*a*, 26*b*, may be of variable thickness to define wireways or raceways, that accommodate electrical hardware (wiring) for the sockets 42*a*, 42*b* (and in the second sign 20' as well). At least one of the sockets, shown here as socket 42*a* mounted on sidewall 26*a*, is spring loaded (depressably mounted) by a spring mechanism 43, to allow for easy fluorescent tube 30 removal, by depressing the spring loaded socket 42*a*.

The second sign 20', where the internal cabinet length (l') is greater than ten feet, requires the lights (fluorescent tubes 30) to overlap, as conventional off-the-shelf fluorescent tubes are not greater than ten feet in length. Each fluorescent tube 30 extends from sockets 42*a*, 42*b*, mounted on oppositely disposed sidewalls 26*a*, 26*b*, both sockets 42*a*, 42*b*, are also preferably spring loaded (depressably mounted) by spring mechanisms 43, for easy fluorescent tube 30 removal, by depressing the spring loaded sockets 42*a*, 42*b*. The opposite end of each fluorescent tube 30 is received in an adapter socket 44 mounted to a wireway 45 or raceway along the rear wall 25 of the cabinet 22. These adapter sockets 44 may be a "tombstone " sockets, shown in FIG. 4*c* (with its fluorescent tube electrical connecting mechanism 46 shown), such as a KULKA brand lamp socket, Cat. No. 530, 660 W, 600–1000 V, available from Voltarc Technologies, Inc., 400 Captain Neville Drive, Waterbury, Conn. 06705, USA.

The arrangement of the fluorescent tubes 30 (lights) in the cabinets 22 of the signs 20, 20', determines the internal cabinet depths (d, d'), that serve to establish the overall sign depth (D, D'). The internal cabinet depths (d, d') are less than the overall sign depths (D, D'), as this overall depth accounts for the thickness of the cabinet rear wall 25, any retainer portion that does not overlap with the cabinet body 24 (the non-overlapping portions of the retainer 34 including the graphic unit 32). These internal depths, "d" for sign 20 and "d'" for sign 20', are a combination of two distances, "$d_1$", the cabinet rear wall to socket center/fluorescent tube (light) center distance for the first sign 20 and "$d_1$", the cabinet rear wall to socket center/fluorescent tube center distance for the second sign 20', and "$d_2$", the socket center/fluorescent tube center to diffuser panel 38 distance, that is approximately equal in both signs 20, 20'.

The distance ($d_1$, $d_1'$) between the cabinet rear wall 25 and the socket center/fluorescent tube center is determined by the distance needed to separate the fluorescent tube 30 from the cabinet rear wall 25. This distance ($d_1$, $d_1'$) is based on socket dimensions and safety concerns. The distance ($d_1'$) may be, and typically is, different for both signs 20, 20', due to the different socket arrangements. This distance ($d_1'$) is typically greater in the second sign 20', as compared to the corresponding distance ($d_1$) in the first sign 20, due to the tombstone sockets 44 (FIGS. 3, 4*b* and 4*c*), that account for the increase in cabinet rear wall to socket center/fluorescent tube center distance ($d_1'$).

In the first sign 20, for example, the distance ($d_1$) may be approximately 1.1875 inches (3.02 cm) or greater. In the second sign 20', for example, a typical cabinet rear wall to socket center/fluorescent tube center distance ($d_1'$) includes the distance in the tombstone socket, designated as "r", the distance from the socket center (socket center/fluorescent tube center when a fluorescent tube 30 is in the socket 44) to the wireway 45 (or the edge of the tombstone socket 44 contacting the surface of the wireway 45, that are approximately equal), plus wireway thickness to the cabinet rear wall 25. This distance, "r" typically measures approximately 1.25 inches (3.18 cm), while the wireway typically is of a thickness of approximately 0.4375 inches (1.11 cm), combining for an exemplary distance "$d_1'$" of approximately 1.6875 inches (4.29 cm).

The distance between the socket center/fluorescent tube center and the diffuser panel ($d_2$) is in accordance with industry standards. It is the distance between the socket center/fluorescent tube center and the diffuser panel 38, where the light diffuses uniformly throughout the cabinet 22, such that: 1) the viewer sees the graphic illuminated at a uniform intensity distribution, as opposed to areas of greater intensity, known as "hot spots" and lesser intensity, known as "shadows"; and 2) the viewer has difficulty in determining the direction of the lights 30 in the cabinet 22. Typically, this distance ($d_2$) is approximately 4 inches.

The combined distances, the sum of which is the respective internal cabinet depths, d and d', for the respective signs 20, 20', results in overall cabinet depths D, D', for the respective signs 20, 20', of greater than four inches. This is due largely in part to the distance ($d_2$), typically being approximately 4 inches. The internal cabinet depth d' and resulting overall cabinet depth (D') for the second sign 20' is slightly greater than those corresponding depths associated with the first sign 20, due to the tombstone sockets 44, as explained above (and the desire to keep the fluorescent tubes 30 level between the sockets 42*a*, 42*b* and 44, so as to avoid risking damage to the fluorescent tubes 30).

When these signs 20, 20', are mounted on walls 21 or the like, they extend (protrude) at least greater than four inches therefrom. By extending approximately greater than four inches from the wall 21, these conventional signs 20, 20' are commonly referred to and classified as "high profile."

These conventional "high profile" signs exhibit substantial drawbacks. Their "high profile" cabinets do not conform with the Americans With Disabilities Act Of 1990 (ADA), and in particular the ADA, at 36 CFR XI (Jul. 1, 1996 Edition), Pt. 1191, App. A, Section 4.4.1. This section requires that "Objects projecting from walls with their leading edges between 27 and 80 in (685 mm and 2030 mm) above the finished floor shall protrude no more than 4 in (100 mm) [(100 mm as converted by the ADA)] into walks, halls, corridors, passageways, or aisles."

The technology associated with the conventional signs 20, 20' and the like, is not suitable with "low profile" signs, as "low profile" signs extend not greater than approximately four inches from walls. This is because simply decreasing the distance between the socket center/light center and the diffuser panel ($d_2$), does not allow for the uniform diffusion necessary for proper aesthetics. Rather, the diffusion and subsequent light distribution in the cabinets would be uneven, resulting in unaesthetic hot spots and shadows. Moreover, the viewer could easily visibly distinguish the direction of the fluorescent tubes in the cabinet.

To conform with the ADA, these conventional "high profile" signs 20, 20', with cabinets of greater than four inches in depth, must be placed into the walls, by cutting the walls and setting the cabinets back into them. This retrofitting is expensive and destructive to the walls, and should the wall be a structural or load bearing wall, this retrofitting is not possible.

SUMMARY OF THE INVENTION

The present invention overcomes the problems of the prior art by eliminating the need for tombstone type sockets, and providing a socket adapter that receives conventional sockets, and mounts along the rear of the cabinet, such that the distance between the rear wall of the cabinet and the center of the socket (or center of the fluorescent tube, when the fluorescent tube is electrically connected in the socket), is reduced significantly when compared to the prior art "tombstone" sockets. This significant reduction in distance assists in reducing cabinet depths, allowing for the creation of "low profile" signs.

The present invention is directed to a socket adapter for use with a socket designed to receive fluorescent tubes of predetermined diameters, the socket having a first portion and a second portion of different dimensions. The first socket portion is bounded within the periphery of said second socket portion. This second portion is adapted to receive the fluorescent tube in electrical communication in a substantially coaxial alignment, through the respective centers of the socket second portion and the fluorescent tube. The socket adapter has a housing formed by an outer shell having a base at a lower end, the base having a lower surface defining an edge surface of the housing. The outer shell at least partially bounds an internal cavity, that is adapted to receive at least the first socket portion. The cavity and the outer shell are cooperatingly configured with respect to each other, such that the first socket portion is supported in the cavity in a position where the second socket portion extends to a point substantially coplanar with the edge surface of the housing, such that the distance between the center of the socket and the edge surface of the housing is minimized.

BRIEF DESCRIPTION OF THE DRAWINGS

The present invention will be described with reference to the accompanying drawings wherein like reference numerals indicate corresponding or like components. In the drawings.

DETAILED DESCRIPTION OF THE DRAWINGS

Figure 1:
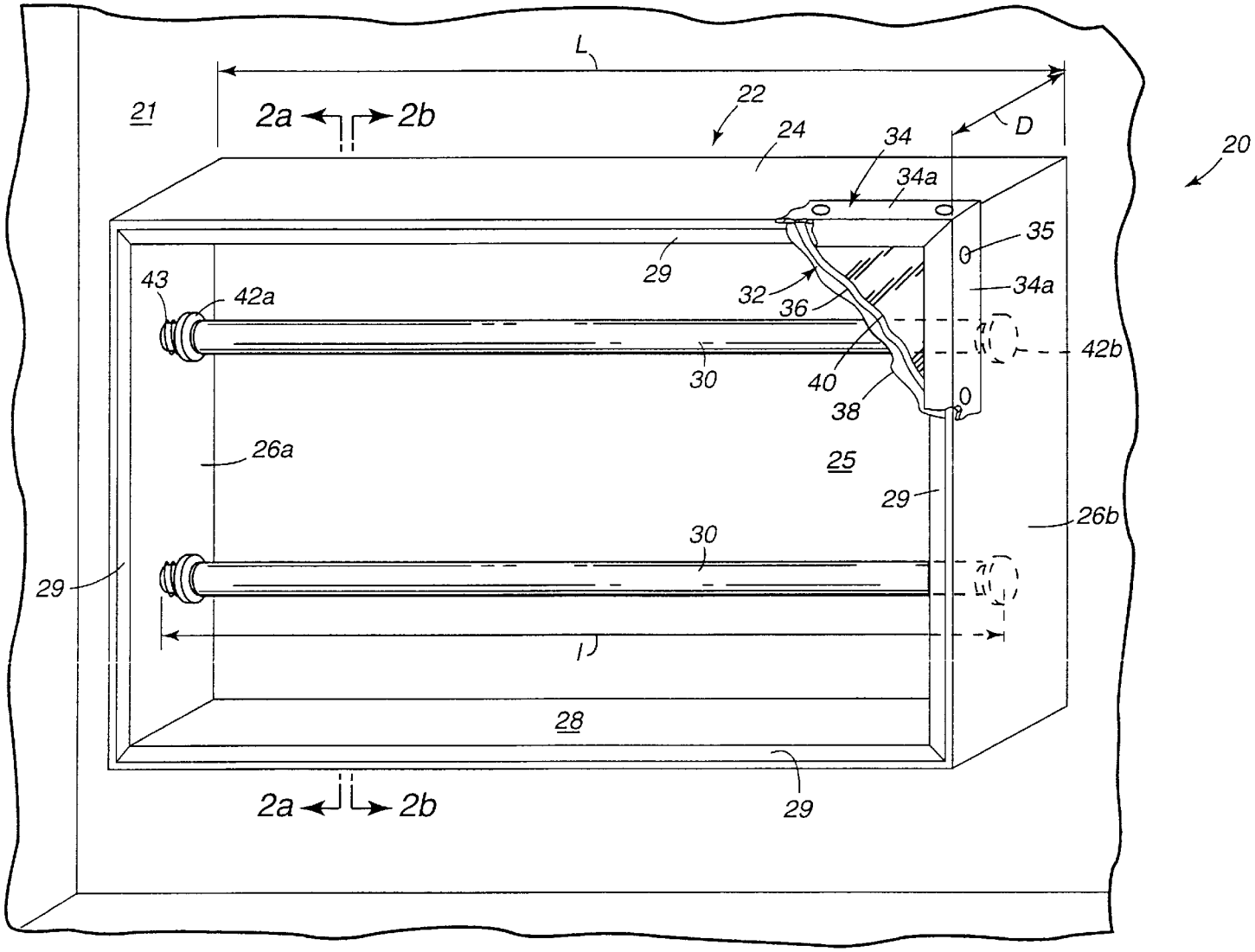
FIG. 1 is a perspective view of a high profile sign in accordance with the prior art.
Figure 2A:
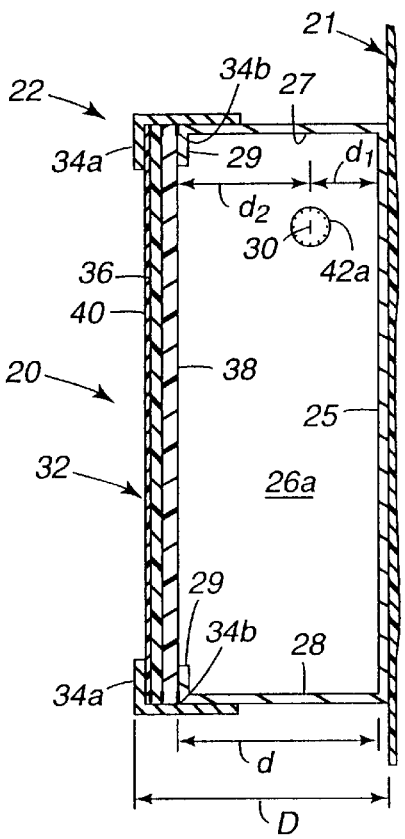
FIGS. 2*a* and 2*b* are cross sectional views of the high profile sign of FIG. 1 taken along lines 2*a*—2*a* and 2*b*—2*b* respectively (only one fluorescent tube is shown)
Figure 2B:
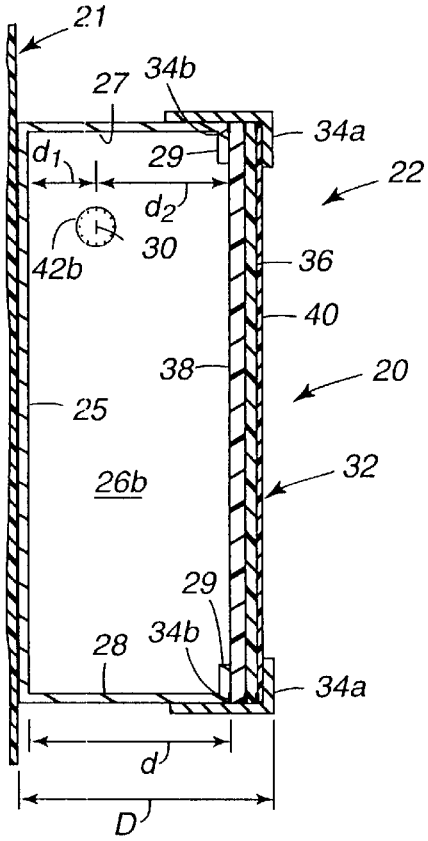
Figure 3:
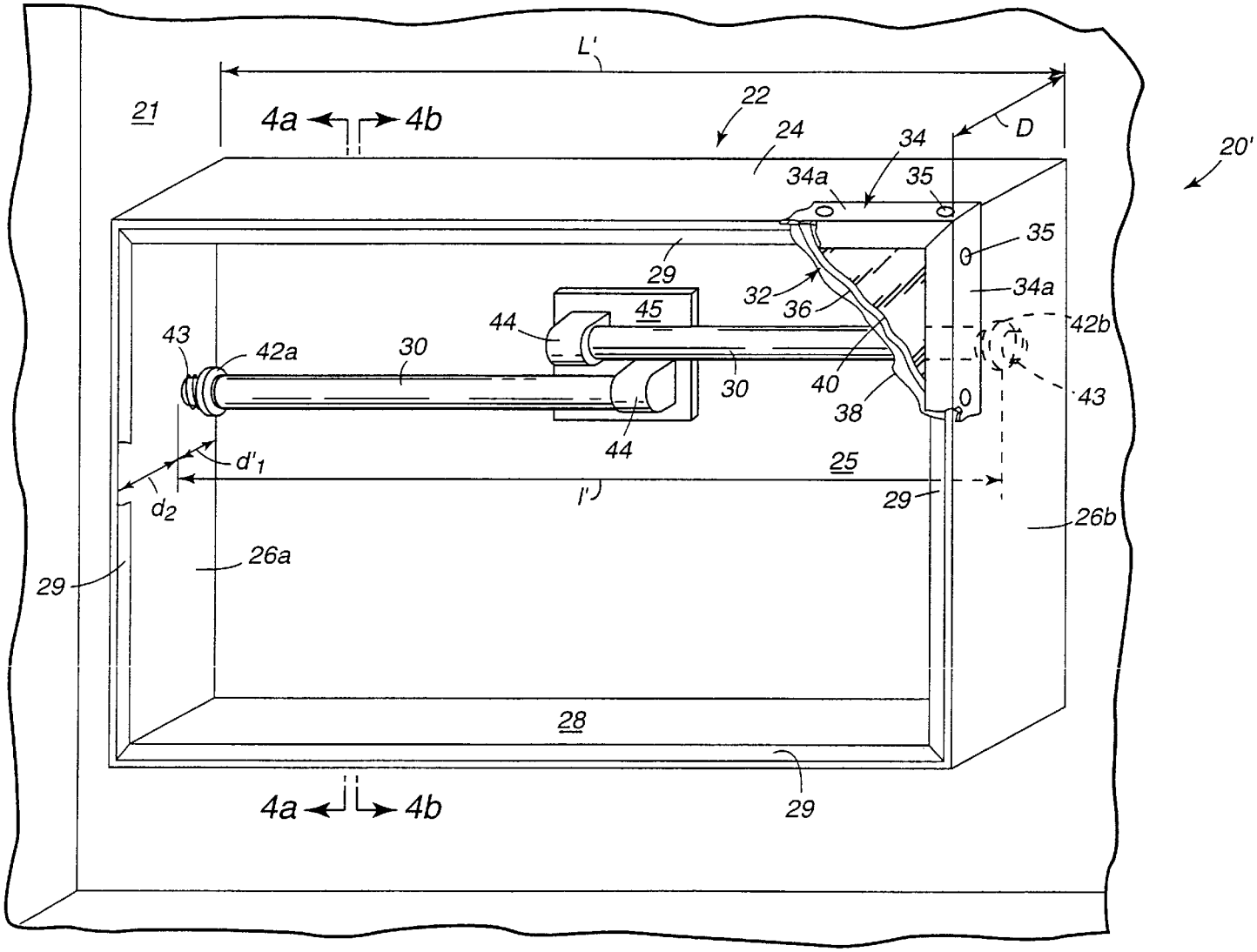
FIG. 3 is a perspective view of a second high profile sign in accordance with the prior art.
Figure 4A:
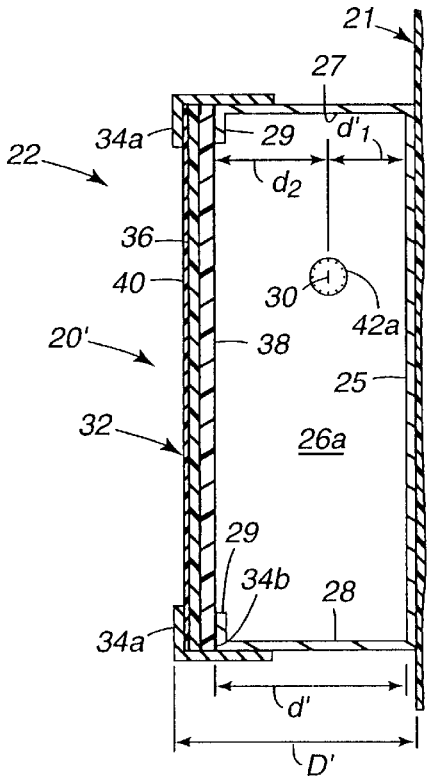
FIGS. 4*a* and 4*b* are cross sectional views of the high profile sign of FIG. 3 taken along lines 4*a*—4*a* and 4*b*—4*b* respectively (only one fluorescent tube is shown)
Figure 4B:
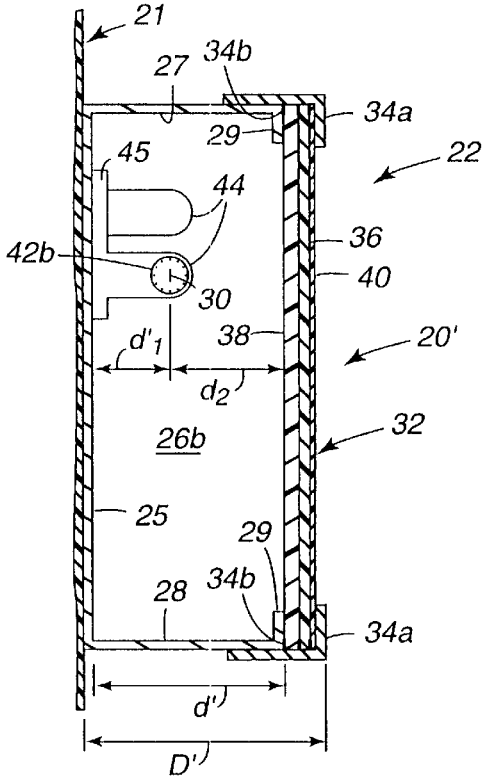
Figure 4C:
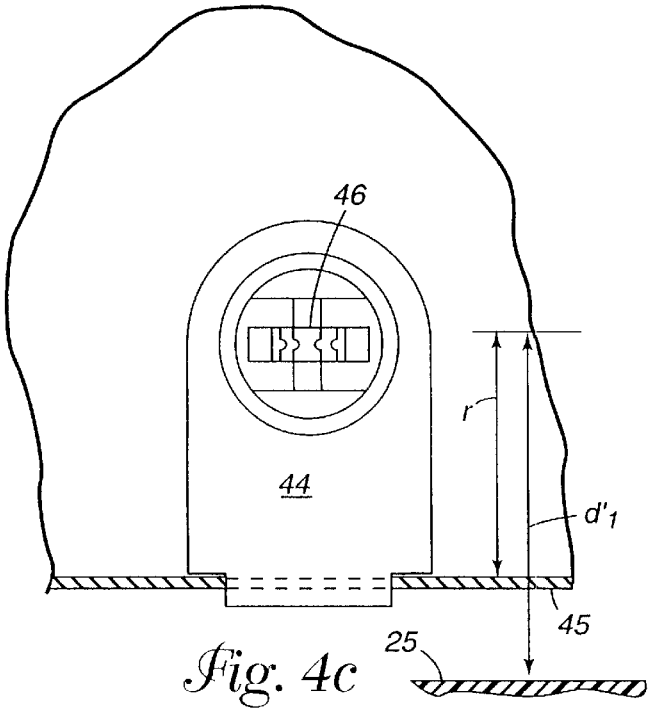
FIG. 4*c* is a front view of the "tombstone" socket shown in FIGS. 3 and 4*b;*

FIGS. 5–12, detail the socket adapter 100 of the present invention in use with a sign 102. Similar to FIGS. 1–4*c*, these drawing figures are diagrammatic, to illustrate the structures detailed below, and accordingly are not to scale. Additionally, in the description of FIGS. 5–12 below, components similar to those of the prior art signs 20, 20', detailed in FIGS. 1–4*c* above, will employ the same reference numerals. Also, these similar components are of the same construction and materials as those detailed above.

Figure 5:
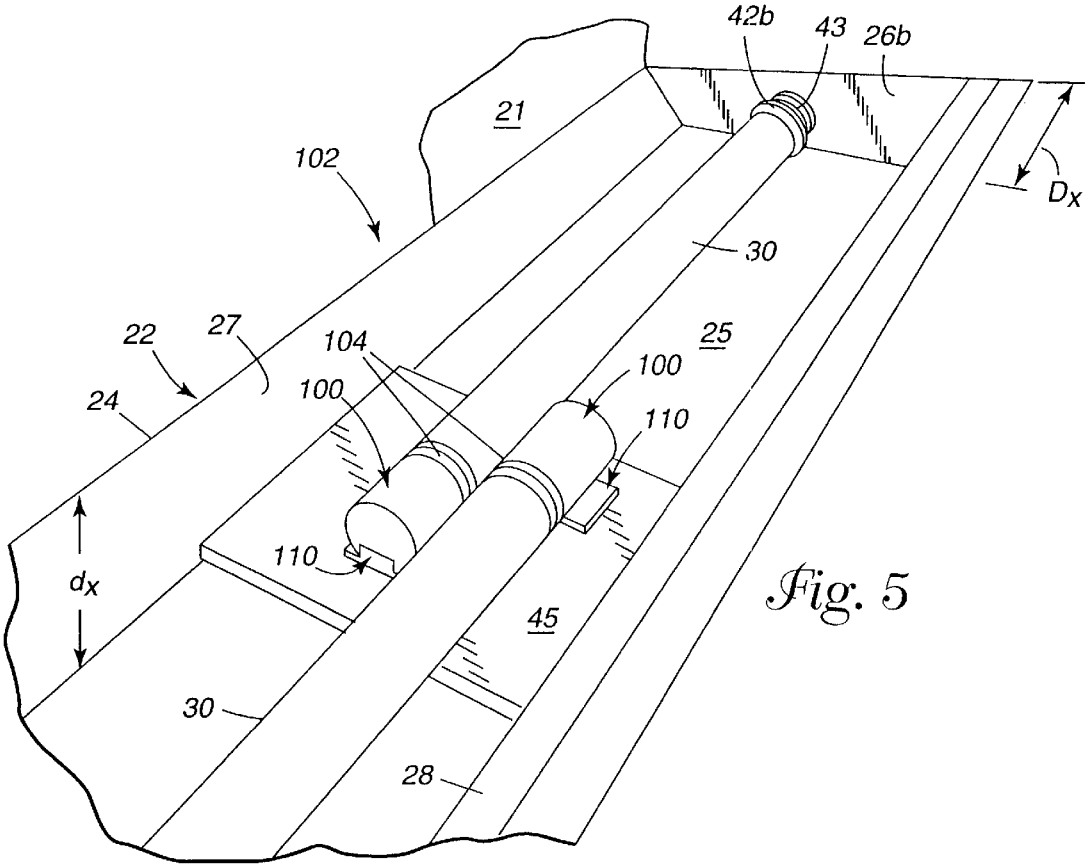
FIG. 5 is a perspective view of the present invention in operation in a light box cabinet of a low profile sign, with the some of the borders, the retainer and graphic unit removed to highlight the present invention.
Figure 11:
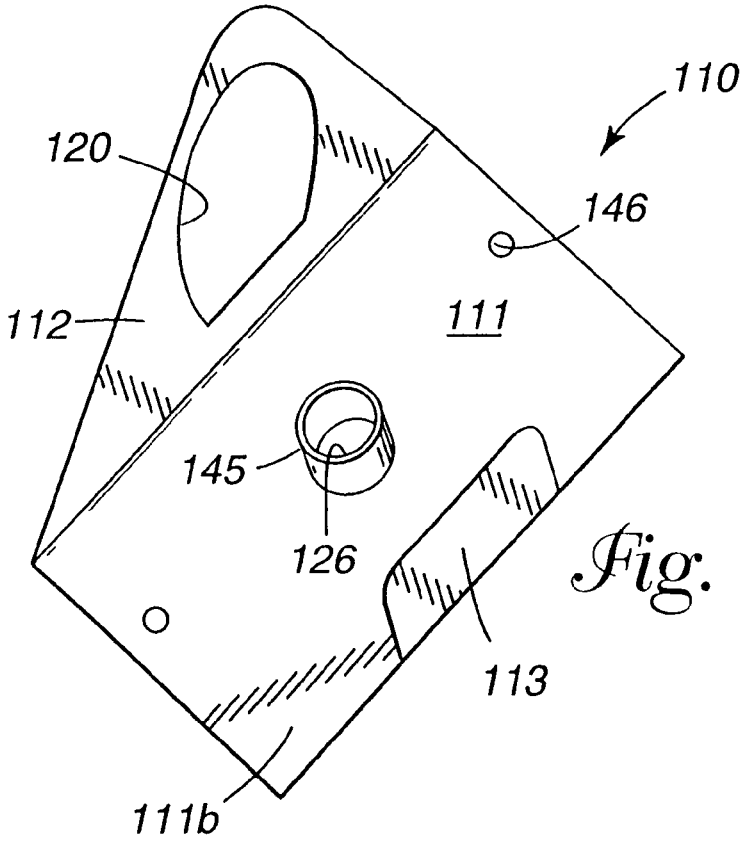
FIG. 11 is a perspective view of the bracket used in the present invention.
Figure 12:
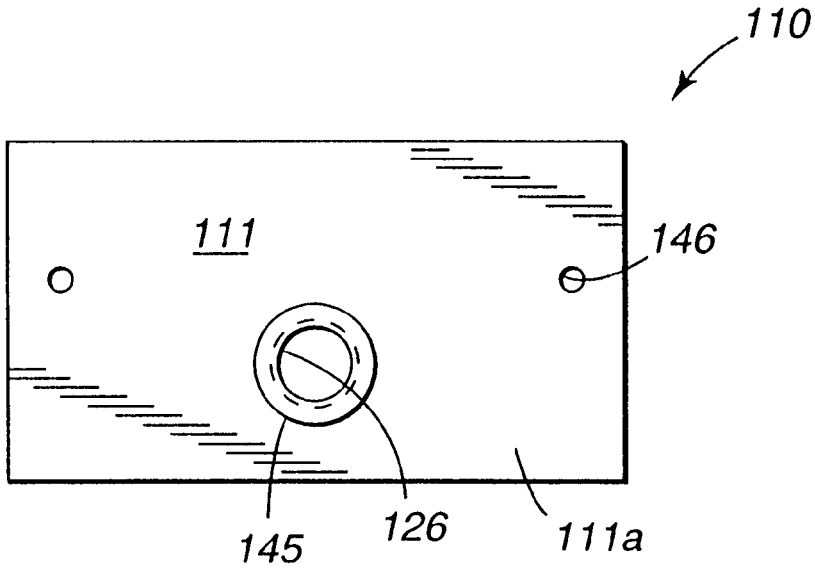
FIG. 12 is a bottom view of the bracket used in the present invention.

As shown in FIG. 5, there are two socket adapters 100 of the present invention in operation as part of a sign 102. Each of the socket adapters 100 serves as a housing for the respective sockets 104, each of these sockets 104 receiving and electrically connecting to the respective fluorescent tubes 30, or other light source, preferably, such that each socket 104 and fluorescent tube 30 are coaxially aligned (through their respective centers). The socket adapters 100 are received and frictionally mounted in brackets 110, along a base 111 (having lower 111*a* and upper 111*b* surfaces, as shown in FIGS. 11 and 12) between the upwardly extending face portion 112 and upwardly extending rear flange 113. The brackets 110 are mounted to wireways 45 attached to the rear wall 25 of the cabinet 22. In this sign 102, the fluorescent tube arrangement is exemplary only, and additional similar arrangements in accordance with the present invention are permissible if desired, typically as necessary to illuminate the requisite cabinet size.

This cabinet 22 for the sign 102 employing the present invention, may have an internal length (corresponding to dimensions l and l' in the prior art signs 20, 20') greater than ten feet, where two overlapping fluorescent tubes 30 would be proper. The cabinet 22 for the sign 102 could also have an internal length less than ten feet if desired, for the cabinet 22 of sign 102 is exemplary to properly illustrate the present invention. This cabinet 22 for the sign 102 is also designed to preferably accommodate borders 29 (only one shown) along the periphery of the open front of the cabinet body 24, and to include a graphic unit and a retainer (not shown), in accordance with those corresponding structures detailed above for the signs 20, 20', for placement onto the cabinet 22 (cabinet body 24), to form the sign 102 in accordance with that described above.

Figure 6:
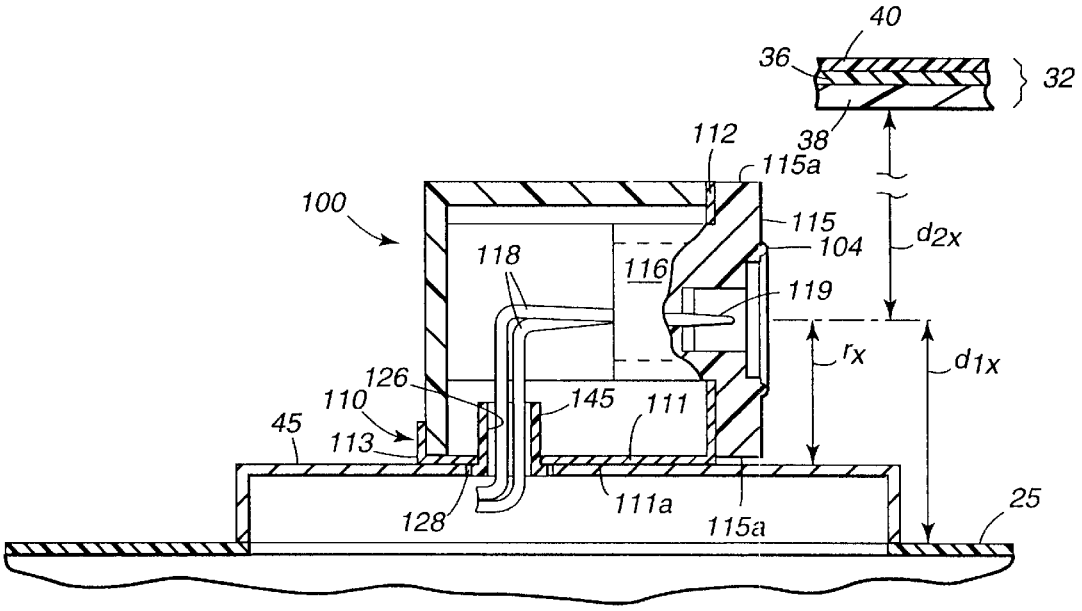
FIG. 6 is a cross-sectional view of the present invention.
Figure 9:
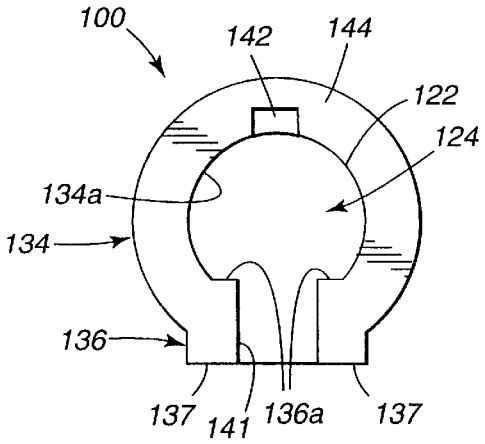
FIG. 9 is a front view of the present invention with the socket removed.
Figure 7:
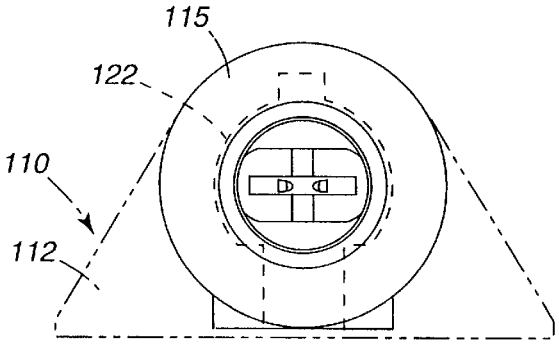
FIG. 7 is a front view of the present invention.
Figure 8:
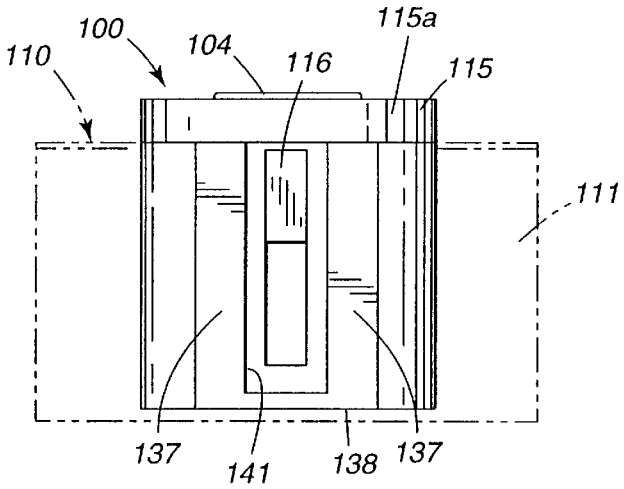
FIG. 8 is a bottom view of the present invention.
Figure 10:
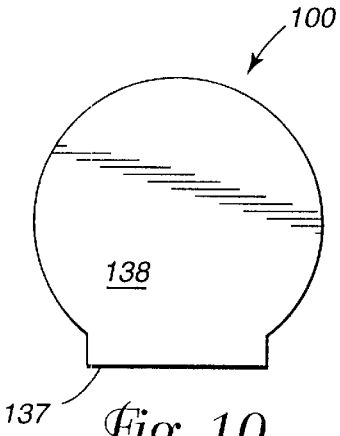
FIG. 10 is a rear view of the present invention.

Turning also to FIG. 6, each of the socket adapters 100 is configured correspondingly to the sockets 104, to receive and retain them in a proper orientation, for proper receipt and electrical connection with the respective fluorescent tubes 30, or other equivalent light sources. The sockets 104, as shown, include an annular collar 115, connected to a stem 116, from which wires 118 extend (the wires 118 in electrical contact with the electrical connection assembly 119 in the socket 104 for connecting with the corresponding connecting structure on a fluorescent tube 30 or other light source). The sockets 104 are preferably D-shaped sockets, known as such as the stem 116 is D-shaped, and for example, may be a KULKA brand socket No. 582 (detailed above). Accordingly, it is preferred that the opening 120 in the face portion 112 of the bracket 110, and the opening 122 and at least a portion of the cavity 124 of the socket adapter 100 be correspondingly D-shaped to retain the stem 116 of the socket 104 in the socket adapter 100, in a manner where rotational movement of the socket 104 is prevented, and thus, keeping the sockets properly oriented for receiving and retaining the fluorescent tube 30 in a proper electrically connected manner. The wires 118 extend from the stem 116 of the socket 104, through a slot 141 (FIG. 9) in the socket adapter 100, and through aligned ports 126, 128 in the bracket 110 and wireway 45, respectively. The wireway 45 includes electrical hardware for supporting the requisite electrical connections with electrical sources or the like.

Although a bracket 110 is shown in the drawing figures and described accordingly, to assist in mounting the socket adapter 100, to the wireway 45, it is not a mandatory component. In accordance with the present invention, the socket adapter 100 could be mounted directly to the wireway 45, by standard mounting techniques, such as adhesives, mechanical fasteners or the like. All other aspects of the present invention would remain similar.

Turning also to FIGS. 7–10, the socket adapter 100 (shown in broken lines in FIG. 7) is preferably formed of a tube portion 134 that merges into a base portion 136, with preferably a flat edge surface 137 for mounting to the bracket 110 along the base portion 111 (FIGS. 11 and 12). It is preferred that the tube 134 and base 136 portions be continuous, such that the socket adapter 100 is of unitary construction. The tube 134 and base 136 portions, as bounded by the rear wall 138, form the interior cavity 124 that is preferably D-shaped (the tube portion 134 along its interior surface 134*a*, forming the rounded segment of the "D" and the plane formed by the interior surfaces 136*a* the base portion 136 forming the linear segment of the "D"). This D-shaped cavity 124 accommodates the socket 104, and in particular, the stem 116 thereof.

Alternate embodiments may have differently shaped tube and base portions, as well as differently shaped interior cavities, depending on the socket to be received and retained therein. Still alternate embodiments may be singular rectangular, triangular tube, or a truncated cylindrical tubes, or tubes combining these geometries, with the interior cavity shaped to correspond to the desired socket.

The base portion 136 of the socket adapter 100 includes a slot 141, preferably extending therethrough, from the opening 122 of the socket adapter 100, to a point proximate the rear wall 138 of the socket adapter 100. The slot 141 is dimensioned to accommodate wires 118 and/or the port 126 in the bracket 110 (should a bracket 110 be present). One or more slots 142 (only one shown) may also be cut into the wall 144 of the tube portion 134, these slots also extending from the opening 122 of the socket adapter 100, to a point proximate the rear wall 138 of the socket adapter 100. Additionally, the slots 141, 142 may be dimensioned to receive optional flange(s) (not shown) protruding from the stem 116 and the socket 104. These single or multiple flanges, as received in the respective slot or slots, would also serve to further inhibit rotational movement of the socket 104 in the socket adapter 100.

Turning back to FIGS. 6 and 7, the aligned openings 120, 122 in the bracket 110 and the socket adapter 100, respectively, are of a diameter less than that of the collar 115 and thus limits only the socket stem 116 to movement into the interior cavity 124. It is preferred that the base portion 136 extend from the tube portion 134 to a point where the edge surface 137 is substantially coplanar or slightly above the plane tangential to the lowest peripheral surface 115*a* of the collar 115. This structural relationship (positioning) minimizes the distance between the center of the socket 104 and the edge surface 137. Similarly, it is preferred that a plane formed by the lower surface 111*a* of the bracket base 111 be substantially coplanar or slightly below the plane tangential to the lowest peripheral surface 115*a* of the collar 115, such that the distance between the center of the socket 104 and the lower surface 111*a* of the bracket base 111 is also minimized.

These minimized distances, resulting from the above described positioning of the socket 104, within the socket adapter 100, held by the bracket 110, bring the socket center (and socket center/fluorescent tube center when a fluorescent tube is in the socket) closer to the wireway 45 (represented by the distance "$r_x$", when compared to the corresponding distance "r" associated with the tombstone sockets 44. Accordingly, the distance ($d_{1x}$) between the socket center/fluorescent tube center and cabinet rear wall 25 is reduced when compared to the corresponding distance ($d_1$') in the second sign 20' of the prior art. This reduced distance ($d_{1x}$) contributes to a reduced cabinet depth and a reduced overall sign depth, allowing for the manufacture of a "low profile" sign.

The socket adapter 100 is preferably of a hard polymeric material including polyester urethane hybrid resins such as, XYCON® (Cook Composites and Polymers Company, Kansas City, Mo.) Nos. 0475205, 0475116 and 0475118, formed by injection molding, extrusion, or other polymer working techniques. The socket adapter is preferably a single piece, but could be of multiple pieces (formed by injection molding, extrusion or the like) fastened together, by conventional materials fastening techniques.

As shown in FIGS. 11 and 12, the bracket 110 is dimensioned to accommodate the socket adapter 100 in a frictional engagement, along its base portion 111, between the face portion 112 and the rear flange 113. This frictional engagement is loose, but becomes tighter as the socket stem 116 is placed through D-shaped opening 120 on the face portion 111 and into the cavity 124 of the socket adapter 100, essentially locking the socket adapter 100, socket 104, and bracket 110 in place with respect to each other. Should additional frictional retention be desired, either or both of the face portion 112 and the flange 113 may be bent slightly inward (toward each other), as desired, and should further securement of the socket adapter 100 to the bracket 110 be desired, such securement can be achieved with adhesives, mechanical fasteners or the like. The bracket port 124 that extends through the base 111 is preferably a tube 145 of a polymeric material. The bracket 110 is preferably attached to the wireway 45, by screws (not shown) placed through the openings 146 in the base 111. The bracket 110 could also be attached to the wireway 45 by adhesives or the like.

The bracket 110 is preferably of a metal, such as stainless steel, aluminum, or the like. It is preferably formed as a sheet, cut accordingly with the face portion 112 and rear flange 113, and openings (port openings and screw openings 146) formed by conventional metalworking techniques. The bracket 110 is preferably a single piece, but could be of multiple pieces, fastened together by conventional metal fastening techniques.

This socket adapter 100 of the present invention, preferably in combination with the bracket 110, in the sign 102, can be used in combination with the applicants' invention, as described in a commonly owned U.S. patent application entitled: LIGHT DIFFUSER DEVICE, that application being incorporated by reference in its entirety herein, for making "low profile" signs. The light diffuser devices, including tapes, tubular members with these tapes, or tubular members having light diffusing elements, as disclosed in the above-listed patent application, may be applied to or over the fluorescent tubes 30, in accordance with that disclosed in the applicants' commonly owned patent application, to reduce the distance from the socket center/fluorescent tube center to the diffuser panel ($d_{2x}$), when compared to the corresponding distances ($d_2$) in the signs 20, 20' of the prior art. This reduced "$d_{2x}$" distance combines with a reduced "$d_{1x}$" distance (detailed above) to allow for production of a "low profile" sign, as the overall sign depth $D_x$ would be less than 4 inches, placing the sign in compliance with the ADA (above).

An exemplary sign could be constructed in accordance with FIGS. 5 and 6, employing the socket adapters 100 (FIGS. 5–12) of the present invention, as shown and detailed above. In this exemplary sign, a device, in a tape form, disclosed in the above-listed patent application entitled: LIGHT DIFFUSER DEVICE, could be placed directly on the fluorescent tubes, oriented toward the direction of the diffuser panel 38. The following dimensions are feasible, such that this exemplary sign can be produced as a "low profile" sign. The dimension $d_{1x}$ can be approximately 1.3125 inches. The components of $d_{1x}$ are "$r_x$", which can be approximately 0.875 inches, plus the wireway 45 depth, that is approximately 0.4375 inches. With respect to the distance "$r_x$", approximately 0.0625 inches of this can be from the thickness of the bracket base 111, plus the radius of the collar 115 of the socket 104, that is approximately 0.8125 inches. The socket center/fluorescent tube center to diffuser panel distance ($d_{2x}$) can be approximately 2.25 inches, providing a cabinet internal depth ($d_x$) of 3.5625 inches. The cabinet 22 can have a depth from outermost edge to outermost edge, in the direction of dimension $d_x$, of 3.625 inches, this dimension including $d_x$ and accounting for the thickness of the cabinet rear wall 25. The retainer 34, as placed on the cabinet 22, can extend forward (including the thickness of the retainer members 34*a*, that can be approximately 0.060 inches), an additional 0.3438 inches, whereby the resultant sign depth $D_x$ would be approximately 3.9688 inches, placing this sign in compliance with the ADA.

While the invention has been described in connection with an embodiment, it will be understood that the invention is not limited to that embodiment. The invention is intended to cover all alternatives, modifications and equivalents as may be included within the spirit and scope thereof, as defined by the appended claims.

What is claimed is:

1. A socket adapter for use with a socket designed to receive fluorescent tubes of predetermined diameters, said socket having a first portion and a second portion of different dimensions, said first portion bounded within the periphery of said second portion, said second portion adapted to receive said fluorescent tube in a substantially coaxial alignment, said socket adapter comprising:

a housing including:

an outer shell, said outer shell including a base at a lower end, said base having a lower surface defining an edge surface of said housing;

a cavity bounded at least partially by said outer shell, said cavity adapted to receive at least said first portion of said socket;

said cavity and said outer shell cooperatingly configured with respect to each other such that said first portion of said socket is supported in said cavity in a position where said second portion of said socket extends to a point substantially coplanar with said edge surface of said housing, such that the distance between the center of said socket and said edge surface of said housing is minimized.

2. The socket adapter of claim 1, wherein said edge surface of said housing is substantially flat.

3. The socket adapter of claim 1, wherein said edge surface of said housing extends along a first plane, said first plane being substantially parallel to the horizontal.

4. The socket adapter of claim 2, wherein said outer shell additionally includes a tubular portion connected to said base, the internal area between said tubular portion and said base defining said cavity.

5. The socket adapter of claim 4, wherein said cavity is D-shaped.

6. A socket adapter for use with a socket designed to receive fluorescent tubes of predetermined diameters, said socket having a first portion and a second portion of different dimensions, said first portion bounded within the periphery of said second portion, said second portion adapted to receive said fluorescent tube in a substantially coaxial alignment, said socket adapter comprising:

a housing including:

an outer shell, said outer shell including a base at a lower end, said base having a substantially flat surface defining an edge surface of said housing;

a cavity bounded at least partially by said outer shell, said cavity adapted to receive at least said first portion of said socket;

said cavity and said outer shell cooperatingly configured with respect to each other such that said first portion of said socket is supported in said cavity in a position where said second portion of said socket extends to a point substantially coplanar with said edge surface of said housing, such that the distance between the center of said socket and said edge surface of said housing is minimized.

7. The socket adapter of claim 6, wherein said outer shell additionally includes a tubular portion connected to said base, the internal area between said tubular portion and said base defining said cavity.

8. The socket adapter of claim 7, wherein said cavity is D-shaped.

9. A socket adapter for use with a socket designed to receive fluorescent tubes of predetermined diameters, said socket having a first portion and a second portion of different dimensions, said first portion bounded within the periphery of said second portion, said second portion adapted to receive said fluorescent tube in a substantially coaxial alignment, said socket adapter comprising:

a housing including:

an outer shell, said outer shell including a base at a lower end, said base having a lower surface defining an edge surface of said housing;

a substantially D-shaped cavity bounded at least partially by said outer shell, said cavity adapted to receive at least said first portion of said socket;

said cavity and said outer shell cooperatingly configured with respect to each other such that said first portion of said socket is supported in said cavity in a position where said second portion of said socket extends to a point substantially coplanar with said edge surface of said housing, such that the distance between the center of said socket and said edge surface of said housing is minimized.

10. The socket adapter of claim 9, wherein said edge surface of said housing is substantially flat.

11. The socket adapter of claim 9, wherein said edge surface of said housing extends along a first plane, said first plane being substantially parallel to the horizontal.

12. The socket adapter of claim 11, wherein said outer shell additionally includes a tubular portion connected to said base, the internal area between said tubular portion and said base defining said cavity.

13. A low profile sign comprising:

a cabinet having a rear wall and oppositely disposed sidewalls, adjacent said rear wall;

at least one fluorescent tube of a predetermined diameter;

a light diffuser device in communication with said fluorescent tube;

a first socket and a second socket for receiving said at least one fluorescent tube in an electrically connected manner, at least said second socket having a first portion and a second portion of different dimensions, said first portion bounded within the periphery of said second portion;

said first socket in communication with at least one of said oppositely disposed sidewalls; and a socket adapter comprising a housing having a lower edge in communication with said cabinet rear wall and a cavity adapted for receiving at least said first portion of said second socket in a position where said second portion of said second socket extends to a point substantially coplanar with said edge surface of said socket adapter, such that the distance between the center of said second socket and said edge surface of said socket adapter is minimized.

14. The sign of claim 13, wherein said cabinet additionally comprises a body said rear side of said body defining said rear wall and said sides of said body defining said oppositely disposed rear walls, said front side of said body being substantially open and adapted to receive a graphic unit at a side, oppositely disposed from said rear wall and adjacent to said sidewalls, and said light diffuser device is oriented about said at least one fluorescent tube in the direction of said graphic unit.

15. The sign of claim 14, wherein said graphic unit is supported by a frame that attaches to said cabinet body.

16. The sign of claim 15, wherein said graphic unit comprises a diffuser panel, proximate said rear wall, a cover member, and a graphic panel intermediate said diffuser panel and said cover member.

17. The sign of claim 14, wherein said light diffuser device is a tape attached to said fluorescent tube.

* * * * *